United States Patent [19]

Prophet, Jr. et al.

[11] Patent Number: 4,483,455

[45] Date of Patent: Nov. 20, 1984

[54] FOOD STORAGE CONTAINER SYSTEM

[75] Inventors: Wilson B. Prophet, Jr., South Norwalk; William G. Wolfe, Riverside; Thomas J. Simmons, Weston, all of Conn.

[73] Assignee: The Carousel Group, Inc., East Norwalk, Conn.

[21] Appl. No.: 409,874

[22] Filed: Aug. 20, 1982

[51] Int. Cl.[3] ..... B65D 21/02

[52] U.S. Cl. ..... 220/23.83; 220/307; 220/356

[58] Field of Search ..... 220/23.83, 307, 355, 220/356, 18

[56] References Cited

U.S. PATENT DOCUMENTS

| | | | |
|---|---|---|---|
| 769,171 | 9/1904 | Kray . | |
| 846,948 | 3/1907 | Richter . | |
| 2,600,922 | 6/1952 | Rodolfa . | |
| 3,117,692 | 1/1964 | Carpenter et al. . | |
| 3,302,594 | 2/1967 | Barnett et al. . | |
| 3,371,847 | 3/1968 | Stengle, Jr. . | |
| 3,384,260 | 5/1968 | Buffington | 220/23.83 X |
| 3,385,465 | 5/1968 | Bliss . | |
| 3,398,827 | 8/1968 | Laskin . | |
| 3,526,334 | 9/1970 | Ashton et al. . | |
| 3,556,338 | 1/1971 | Wilkinson et al. . | |
| 3,856,178 | 12/1974 | Norgaard . | |
| 4,004,710 | 1/1977 | Crisci | 220/356 X |
| 4,091,953 | 5/1978 | Daenen . | |
| 4,117,946 | 10/1978 | Kessler . | |
| 4,380,304 | 4/1983 | Anderson | 220/307 X |

*Primary Examiner*—Steven M. Pollard

*Attorney, Agent, or Firm*—Parmelee, Bollinger & Bramblett

[57] ABSTRACT

A food storage container system is provided having a plurality of tightly sealable containers, removably seated in shallow sockets in a tray base or rotatable tray of circular or semi-circular configuration. Each container is a sector-shaped hollow body formed by three upstanding side walls which are terminated at the lower end by a bottom wall. Two of the upstanding side walls are substantially planar, being oriented at an angle of 60° one with respect to the other. These two planar side walls merge to form a rounded vertex opposite the third side wall, with the third side wall following an arc of a circle which merges in rounded corners with the two planar side walls. The arc defining the third side wall is concentric about the point at which the two planar side walls would meet at a 60° angle if they were extended to a sharp vertex instead of merging in a rounded vertex. This rounded vertex between the two 60° oriented planar side walls advantageously serves as a convenient pouring spout when the container holds liquid foods or pourable granular or pulverent foods.

11 Claims, 27 Drawing Figures

Fig. 1.
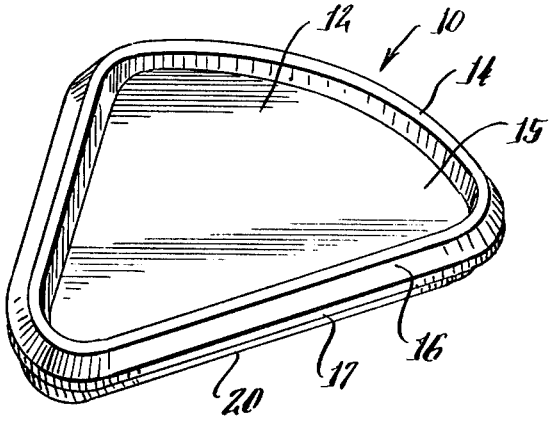
Fig. 2.
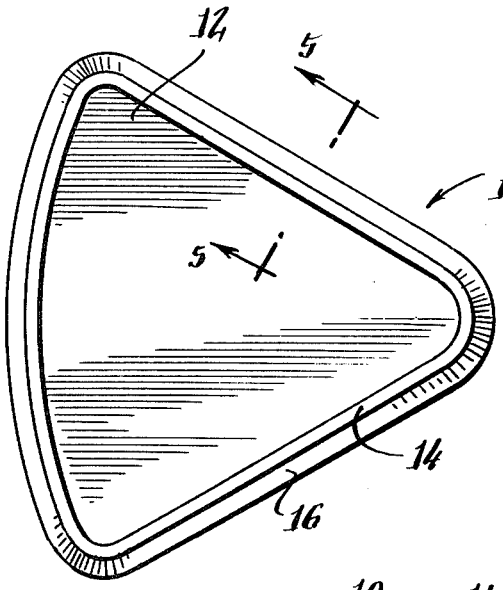
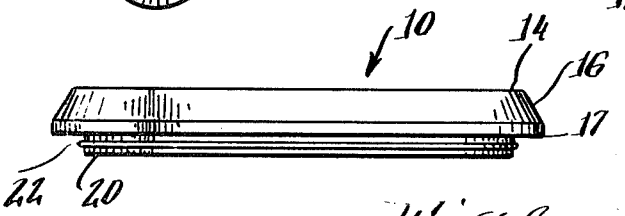
Fig. 3.
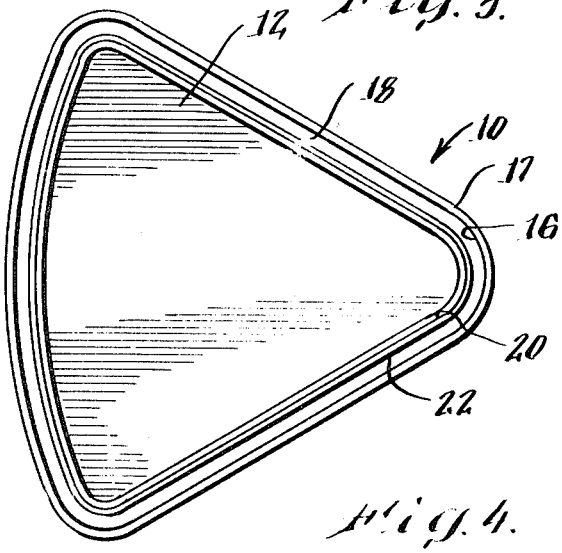
Fig. 4.
Fig. 5.
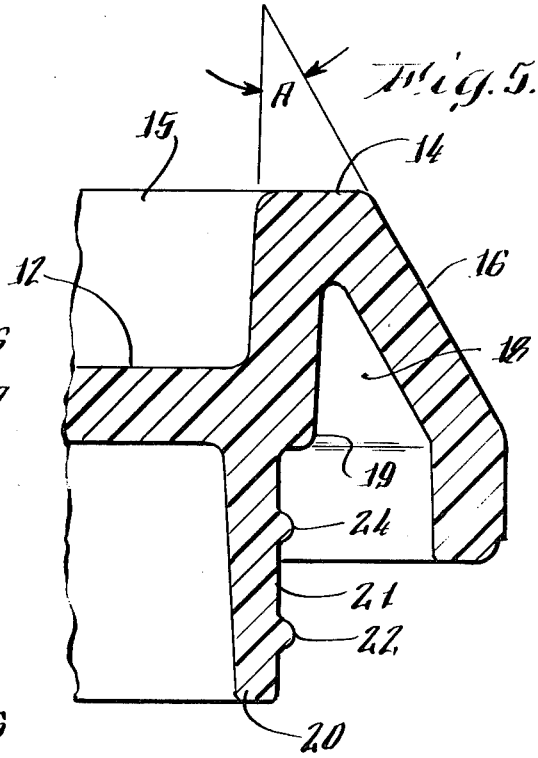

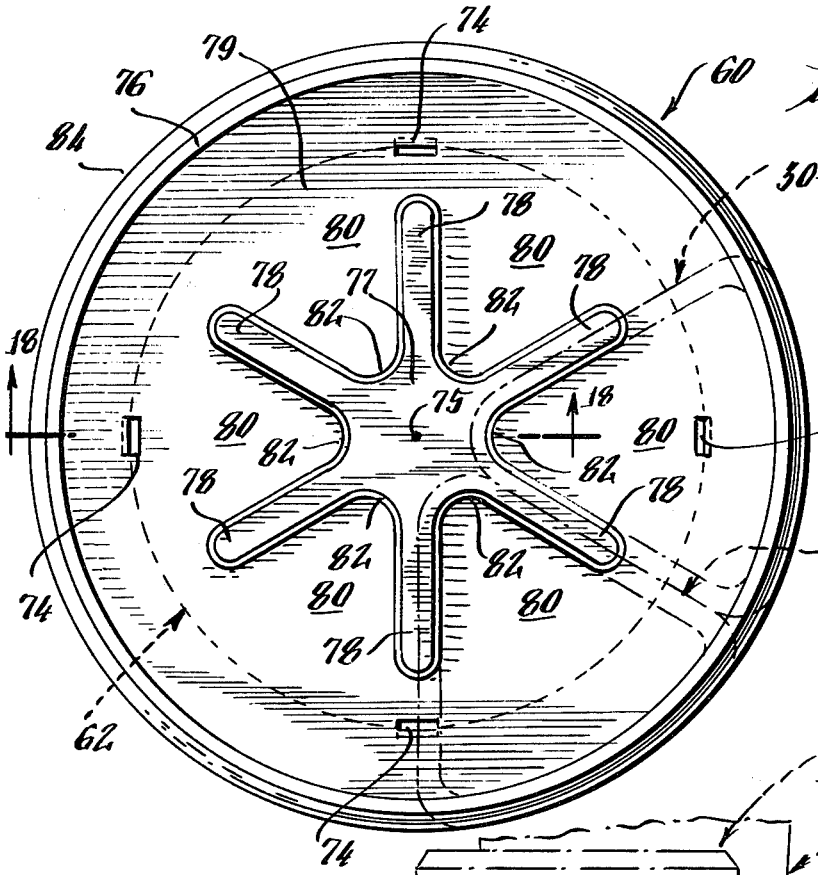
Fig. 15.
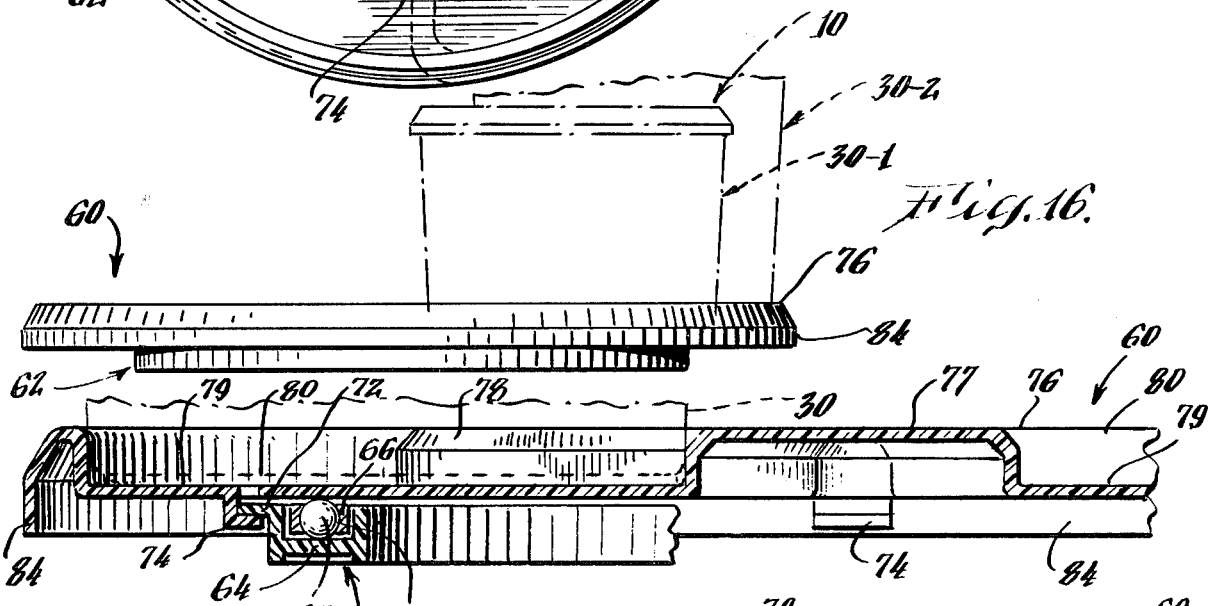
Fig. 16.
Fig. 18.
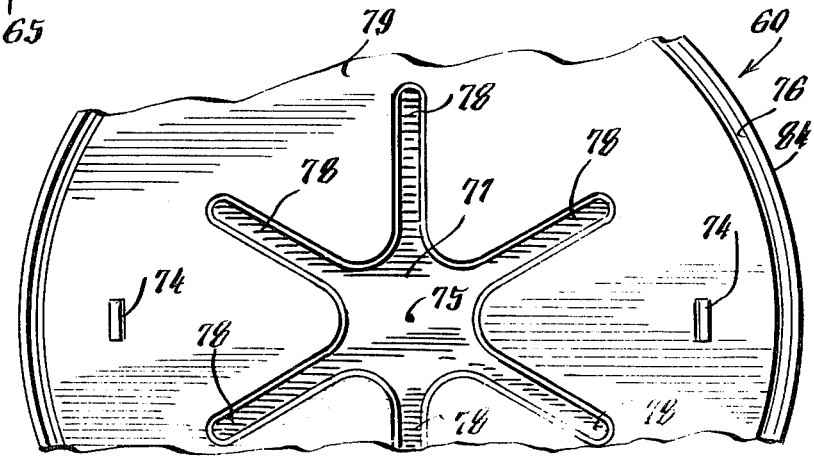
Fig. 17.

FOOD STORAGE CONTAINER SYSTEM

The top rim of the container so formed has a sector-shaped peripheral flange which conforms with the configurations of the integrally formed side walls. There is a triple-seal sector-shaped top closure lid member for the container. This triple-seal closure lid has a top planar horizontal wall with an integrally formed shaped skirt extending downwardly which is adapted to fit into the rim of the container body. This closure lid has an elevated upstanding rim with a downturned ledge lip forming an angled channel within and beneath the downturned lip which is adapted to receive the peripheral flange of the container body. The skirt includes a pair of spaced, parallel, rounded, horizontal sealing ridges extending outwardly from the external surface of the skirt. These sealing ridges are adapted to contact the interior surfaces of the container body when the closure lid is mounted on the container body, thereby providing a double seal for the container. A third seal is provided by a rounded shoulder located within the angled channel beneath the downturned lip on the closure lid. This rounded shoulder engages the rim of the container for making the third seal of the triple-seal action.

This downturned lip overhangs the flange of the rim of the container body, thereby enabling the ready removal of the triple-sealed closure lid from the container body. In one form, the rotatable tray on which the plurality of containers are removably seated has a plurality of radial finger ribs extending from a central web on the revolving base member of the rotatable tray which defines or delineates six shallow sectored sockets into which the bottoms of the containers are non-slidably seated. Thus, when the base member is revolved, the containers seated in the sockets defined by the separated radial finger ribs are prevented from slidable or shifting movement relative to the base member. In another form, the system includes a semi-circular shelf having radial finger ribs extending from the base thereof defining shallow sockets for holding three containers on the shelf being mountable on a wall by a wire bracket. The container systems have attractive functional containers for compactly and neatly storing food items in a modern kitchen, with these containers being triple-sealed, yet providing ready access to the contents, and the containers may be stored on a rotatable tray base or on a wall rack mounting, providing non-slidable socket seating for each container in the system. The containers are in modular heights, for example of three, six and nine inches, and can be conveniently stacked in a non-slidably seated relationship one on top of another in various combinations as desired by the user for most efficiently utilizing the available space.

FIELD OF THE INVENTION

This invention relates generally to food storage container systems.

BACKGROUND OF THE INVENTION

A large variety of canister sets and food storage containers are utilized for storing a wide variety of food items and products, such as dry, granular material like flour, sugar, salt, etc., or pasta products, grains, nuts or rice, or a variety of other foods such as cole slaw, egg salad, potato salad, leftovers, etc.

One problem with all of these containers is storage space and the lack of or difficulty in accessibility of the container once it is put in that storage space. Whether the storage space be in the refrigerator or on a pantry shelf, such space is generally characterized by being deeper from the front to the rear than an individual canister or container, which makes the container stored in the rear inaccessible without removing the front ones first or if they are all arranged rectilinearly in a single row along the front of the shelf, then rear space is bound to be sacrificed.

Also, space is often wasted between the tops of the various containers and the bottom of the next upper shelf in the storage space. The prior containers do not readily stack in ways for efficiently utilizing available space.

Often the user is required to cover and attempt to seal prior containers with aluminum foil or with a clinging-type of plastic or film or to attempt to use screw-on covers which later jam or stick, becoming difficult to re-open. Alternatively, the prior covers are loose fitting or do not provide a tight seal.

SUMMARY OF THE DISCLOSURE

Accordingly, it is an object of the present invention to provide a new and improved food storage container system which will accommodate a variety of food items of different types in similar shaped, different sized modular containers which, when assembled and positioned as a set, provide a maximum storage volume for the area occupied, with increased accessibility.

A further object of this invention is to provide a new and improved food storage container system which is inexpensive and facilitates the handling and storage of a wide variety of food articles in various modular, stackable arrangements.

Among the advantages of the present invention are those resulting from the fact that the sector-shaped containers are in modular heights, for example of three, six and nine inches and can be conveniently stacked one on top of another in non-slidably seated relationship in various combinations as may be desired by the user for most efficiently utilizing the available storage or shelf space, including most efficiently utilizing the available vertical distances from shelf-to-shelf.

In carrying out this invention in one illustrative embodiment thereof, a plurality of sector-shaped, modular containers are assembled as a set which are non-slidably seated on a shelf or on a rotatable tray in order to provide maximum accessibility as well as maximum storage volume for the shelf area in which the system is located. Each container of the group or set has a sector-shaped hollow body formed by three upstanding side walls which are terminated in a planar bottom. Two of the upstanding planar side walls converge at an angle of 60° and merge to form a rounded vertex opposite the third side wall which conforms to an arc of a circle and merges in rounded corners with the two planar side walls. This third side wall follows the arc of a circle concentric about the point at which the two planar side walls would meet at a 60° angle if they were extended to a sharp vertex instead of merging in the attractive rounded vertex. Advantageously this rounded vertex may serve as a convenient pouring spout when desired. The sector-shaped body has a peripheral flange on its rim. A triple-seal sector-shaped top closure lid is provided, having a top planar horizontal wall with an integrally formed shaped skirt extending downwardly around the perimeter of the lid which is adapted to engage into the rim of the body member. This lid has an elevated upstanding rim with a downturned ledge lip forming an angled channel within and beneath the downturned lip which is adapted to receive the peripheral flange of the container body. This skirt includes a pair of spaced, parallel, rounded, horizontal sealing ridges extending outwardly from the external surface of the skirt. These sealing ridges are adapted to contact the interior surfaces of the rim of the container when the closure lid is placed on the container, thereby providing two seals of the triple-seal for the container. In addition, a third seal is provided by a rounded shoulder located within the angled channel beneath the downturned lip on the closure lid. This rounded shoulder engages the rim of the container for making the third seal of the triple-seal action. The downturned lip overhangs the flange of the rim of the container body thereby enabling the ready removal of the triple-sealed closure lid from the container body.

In one form, the rotatable tray on which the plurality of containers are removably and non-slidably seated has a plurality of radial finger ribs extending from a central web on the revolving base member of the rotatable tray which defines or delineates six shallow sectored sockets into which the bottoms of the containers are non-slidably seated. Thus, when the base member is revolved, the containers seated in the sockets defined by the separated radial finger ribs are prevented from sliding or shifting movement relative to the base member. In another form, the system includes a semi-circular shelf having radial finger ribs extending from the base thereof defining shallow sockets for holding three containers on the shelf being mountable on a wall by a wire bracket.

The container systems have attractive functional containers for compactly and neatly storing food items in a modern kitchen, with these containers being triple-sealed, yet providing ready access to the contents and the containers may be stored in a rotatable tray base or on a wall rack mounting, providing non-slidable socket seating for each container in the system, and the containers are in modular heights, for example of three, six and nine inches, and can be conveniently stacked one on top of another in various combinations as desired by the user for most efficiently utilizing the available space.

BRIEF DESCRIPTION OF THE DRAWINGS

The invention, together with further features, objects, advantages and aspects thereof, will be more clearly understood from a consideration of the following description taken in conjunction with the accompanying drawings in which like elements will be identified with the same reference numerals throughout the various views.

FIG. 1 is a perspective view of a lid closure member for the containers embodying the present invention.

FIG. 2 is a top view of the lid closure member illustrated in FIG. 1.

FIG. 3 is a side elevational view of this lid closure.

FIG. 4 is a bottom view of this lid closure.

FIG. 5 is an enlarged partial cross-sectional view of the upstanding rim of the lid with its downturned skirt and ledge lip taken along line 5—5 of FIG. 2.

FIG. 15 is a top view of a circular rotatable tray base in accordance with the present invention showing in dash-and-dotted outline a pair of containers positioned thereon.

FIG. 16 is a side elevational view of FIG. 15.

FIG. 17 is a bottom view of the tray base before the rotatable bearing ring support has been mounted on the bottom of the tray.

FIG. 18 is an enlarged partial cross-sectional view taken along line 18—18 of FIG. 15 showing a portion of the rotatable bearing ring support.

DESCRIPTION OF THE PREFERRED EMBODIMENTS

Figure 7:
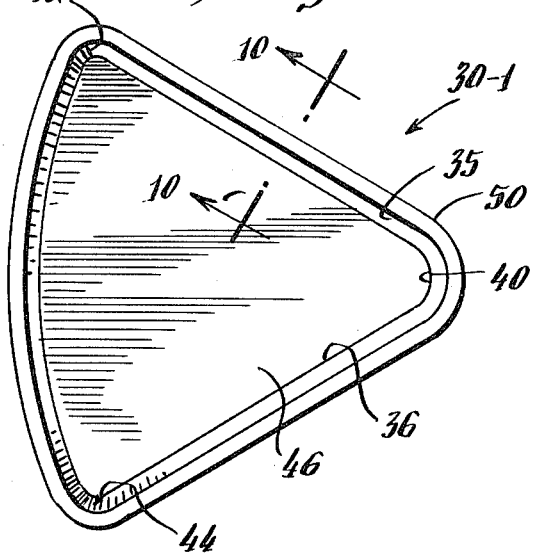
FIG. 7 is a top view of the container shown in FIG. 6.

As shown in FIGS. 1 through 5, a sector-shaped lid closure member referred to generally by the reference numeral 10, is provided for closing and firmly sealing the sector-shaped containers in accordance with the present invention, which will be described in detail further below.

This lid closure member 10 includes a recessed flat planar horizontal cover wall 12 having an elevated upstanding rim 14. A socket recess 15, as can best be seen in FIG. 5, is defined by the planar cover wall 12 and the rim 14. This socket recess 15 is also sector-shaped. It is conveniently adapted to received in modular, non-slidable and readily removable relationship the bottom portion of another similar one of these containers to permit their stacking in any desired arrangement.

A peripheral lip 16 extends downwardly and outwardly from the rim 14 with a vertically downwardly extending margin 17 along the lower boundary of this down-turned lip. This lip 16 slopes downwardly at an angle "A" to the vertical in the range from 20° to 40° and preferably at an angle of 30° as shown. This downwardly sloping lip 16 with its vertical margin 17 defines an angled channel 18 with the rim 14 and an overhanging rounded ledge corner 19 aligned with the lower surface of the horizontal cover wall 12.

As will be explained in further detail later, these sealing ridges 22, 24 and this rounded corner 19 all cooperate and act to provide triple-seal contact regions when the lid closure member 10 is applied to the top of any of the containers 30 employed in the present invention. The lid closure 10 is made of a strong, firm, stiffly and resiliently bendable durable plastic material, for example such as polypropylene.

Figure 9:
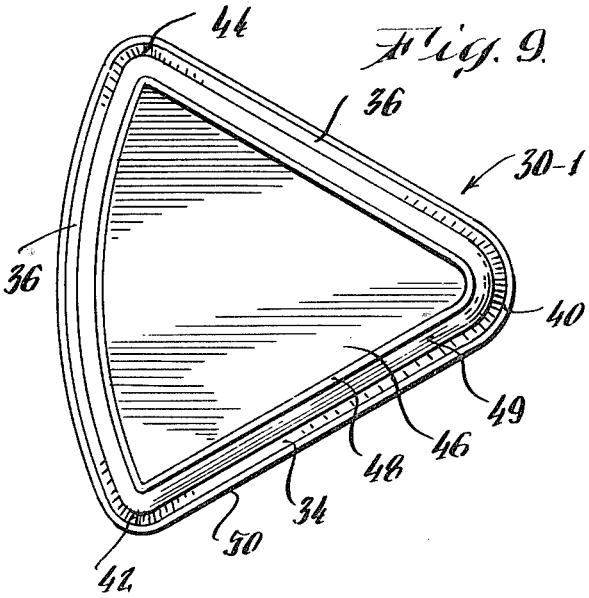
FIG. 9 is a bottom view of this container.

Referring now to FIGS. 6 through 10, there is shown a shorter one of the sector-shaped modular containers and referred to generally by the reference numeral 30, in accordance with the present invention. The short modular container 30-1 has a sector-shaped hollow body 32 formed by three upstanding side walls 34, 36 and 38. Two of these side walls 34 and 36 are substantially planar being oriented at an angle of 60° with respect to the other. These two planar side walls 34 and 36 converge toward a rounded vertex 40 which is opposite to the third arcuate side wall 38. This arcuate third side wall 38 merges with side walls 34 and 36 to form rounded corners 42 and 44. The arc defining the third side wall 38 is approximately concentric about a point 41 (FIG. 7) at which the two planar side walls 34 and 36 would meet at a 60° angle if they were extended to such a sharp vertex instead of merging in the rounded vertex 40. In other words, an attractive pieshaped or sector-shaped container 30-1 is provided which has rounded corners. The hollow body 32 is terminated in a planar horizontal bottom wall 46 with a sector-shaped bottom ridge 48 extending around the bottom as seen in FIG. 9. This bottom ridge 48 is equidistantly spaced at all points from the rounded bottom corner 49 (FIG. 10) where the bottom wall 46 merges into each of the side walls 34, 36 and 38. The hollow body 32 has a peripheral flange 50 integrally formed on its rim, which conforms to the sector shape formed by the three side walls 34, 36 and 38. The container 30 is made of a suitable stiff, resilient transparent plastic, for example such as high impact-resistant polystyrene. The transparency of each container 30 enables the user readily to determine the contents of its interior 51.

Figure 6:
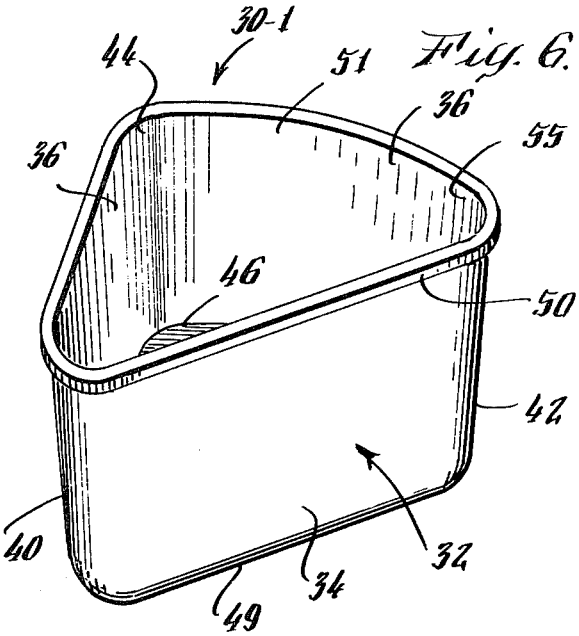
FIG. 6 is a perspective view of a short one of the modular sector-shaped containers in accordance with the present invention.
Figure 8:
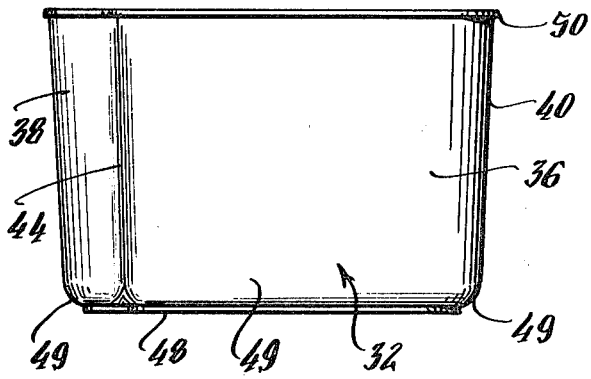
FIG. 8 is a side elevational view of the container shown in FIGS. 6 and 7.
Figure 10:
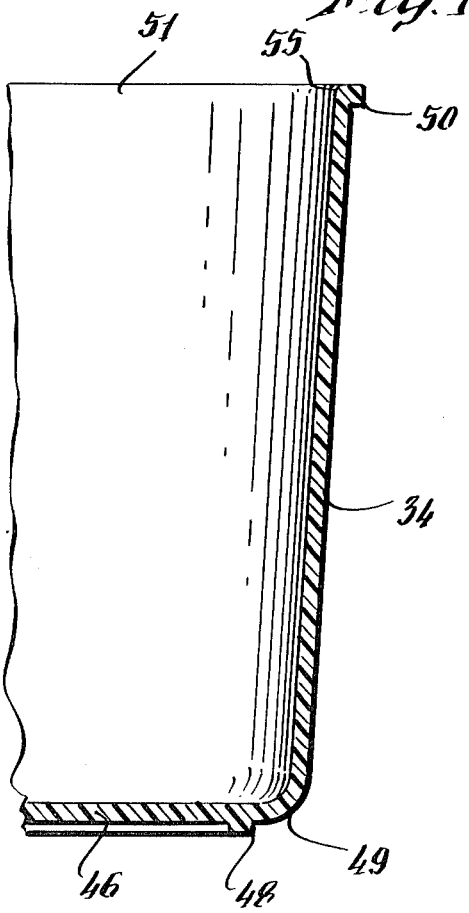
FIG. 10 is an enlarged partial cross-sectional view taken along line 10—10 of FIG. 7.

It is to be noted that the rounded vertex 40 between the two planar side walls 34 and 36 can advantageously serve as a pouring spout as will be appreciated from the perspective view in FIG. 6 when the container 30 holds liquid foods or pourable granular or pulverent foods.

Figure 11:
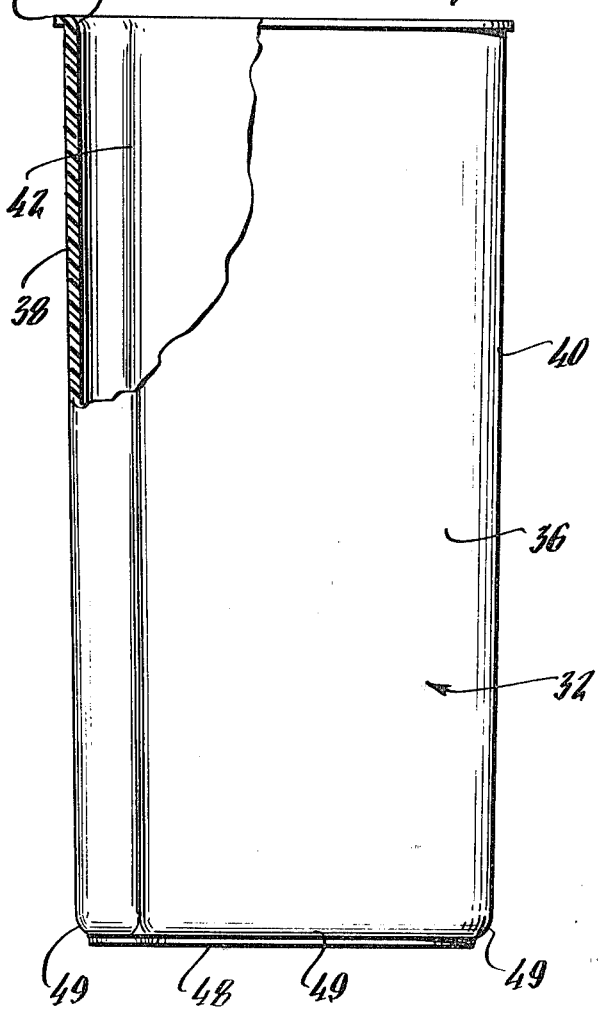
FIG. 11 is a side elevational view of a similar tall modular container in accordance with the present invention with an upper rim and side wall portion shown in section.
Figure 12:
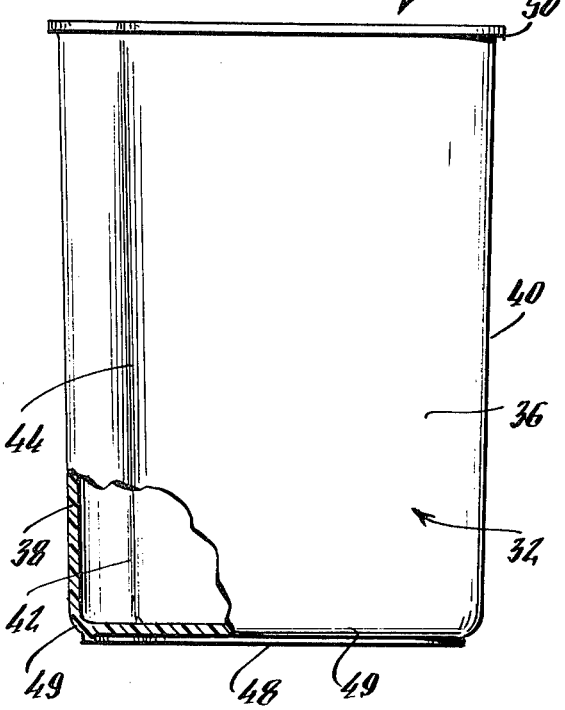
FIG. 12 is a side elevational view of a similar medium-height modular container with a lower side wall and bottom portion shown in section.

It is recalled that FIGS. 6 through 10 show a short container 30-1 of the set of modular containers 30. FIG. 11 shows a tall modular container 30-3, while FIG. 12 shows such a container 30-2 of medium height. For example, the respective containers 30-1, 30-2, and 30-3 have the preferred heights of three, six and nine inches, respectively.

Figure 13:
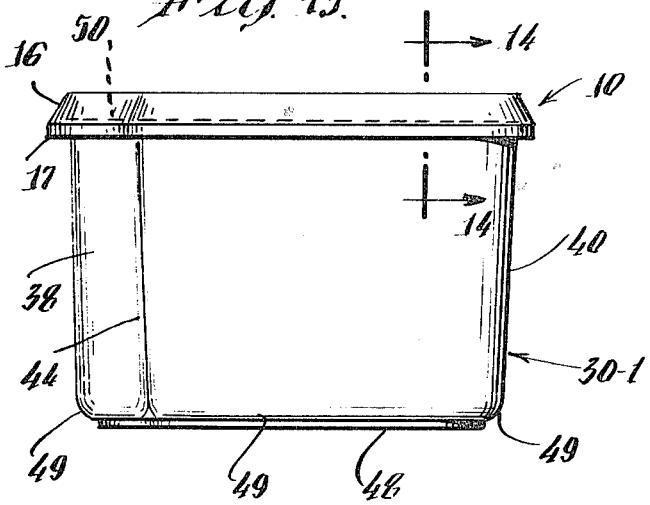
FIG. 13 shows the short container of FIGS. 6 through 9 having the lid closure member of FIGS. 1 through 4 mounted thereon in fully closed position.

As is illustrated in FIGS. 11, 12 and 13, the containers in accordance with the present invention have the same cross-sectional shape and area, but are of the different heights in modular steps to accommodate different types of food articles as well as different volumes of those articles and to enable a wide variety of stacking combinations to be evolved by the user. In accordance with the present invention, these elevations of 3, 6 and 9 inches are preferred because they conveniently relate to shelf spacing. For example, when the vertical shelf spacing is approximatley ten inches or more, the user may stack three of the short containers 30-1, or may stack one short and one medium height container 30-1, 30-2, or may use one tall container 30-3. Each of the foregoing three combinations is nine inches in height, which will conveniently fit into a ten inch or more vertical shelf space.

When the vertical shelf spacing is approximately thirteen inches or more, then the user may stack four short containers 30-1, two short and one medium height container, two medium height containers, or one tall and one short container. Each of these four combinations is twelve inches in height which will conveniently fit into a thirteen inch or more vertical shelf space, and so forth.

Moreover, if there is a smaller vertical shelf space then the short or medium height containers can be used for optimizing the use of all available space. Similarly, various combinations of these modular containers can conveniently be stacked on a kitchen counter beneath a wall-hanging cabinet.

It is to be noted that the bottom portion of each of the tall, medium and short containers 30-3, 30-2 and 30-1 has exactly the same size and shape for nesting snugly but freely removable in the socket recess 15 (FIGS. 5 and 14) in the lid 10 of a lower container in the nested stack.

Also, it is noted that the medium height and tall containers 30-2 and 30-3 each have a ring flange 50, a bottom ridge 48, a rounded vertex 40, rounded side wall corners 42 and 44, and a rounded bottom corner 49 identical in shape with those in the short containers 30-1. Moreover, the planar side walls 34 and 36 and the arcuate side wall 38 of the medium height and tall containers 30-2 and 30-3 are similar in shape and orientation with the corresponding side walls of the short container 30-1. The only differences are in the relative heights of the side walls in the respective modular containers of different heights.

Figure 14:
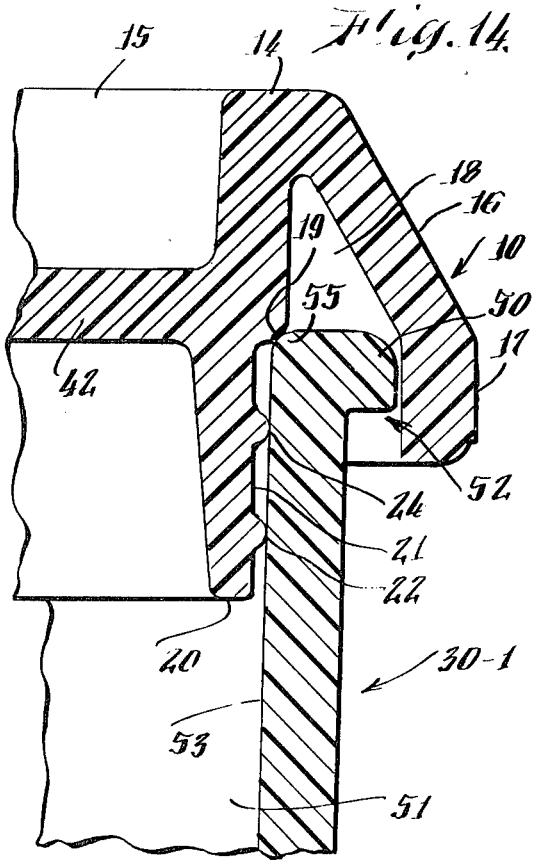
FIG. 14 is an enlarged partial cross-sectional view taken along line 14—14 of FIG. 13 illustrating the triple-seal action.

As is illustrated in FIGS. 13 and 14, the lid closure member 10 is shown sealably positioned on one side of the containers 30, for example the short container 30-1. As will best be seen in FIG. 14, with the closure member in place on the container, the flange 50 enters the lower portion of the lid rim lip channel 18 with the interior surface 53 of the side walls of the container engaging the sealing ridges 22 and 24 as well as the rounded overhanging corner 19 on the lid engaging on the rounded inner corner 55 of the rim of the container. Since the containers 30, the lid closure members 10, as well as the configuration of the sealing ridges 22, 24 and the rounded overhanging corner 19 are all of a complementary sector shape, thus, when the lid closure 10 is placed on the container 30, a triple seal is advantageously formed between the lid closure and the container at ridges 24, 22 and rounded overhanging corner 19. The flange 50 has a peripheral clearance space 52 between it and the downturned lip 16 and its margin 17.

This small clearance gap 52 around the flange 50 facilitates both applying the lid closure member 10 and removing it from the container 30.

In accordance with the present invention, the containers 30 with their lid closure members 10, which have been described above, may conveniently be stored and carried on a revolving circular tray base as illustrated in FIGS. 15 through 18. This revolving circular tray base is referred to generally by the reference numeral 60, and it has a supporting bearing ring housing 62 including a ring-shaped retainer 66 which carries ball bearings 68.

This bearing housing 62 includes a lower bearing race member 64 defining a channel 65 of rectangular cross-sectional shape in which is located the ring-shaped retainer 66 and the multiple ball bearings 68 that are located at uniformly spaced positions along this retainer. This bearing housing 62 is captured against the bottom of the circular tray base 60 by four L-shaped fingers 74 which project down and in beneath the outer flange 72 of the lower bearing race member 64 of the bearing housing 62. The tray base 60 can thus be freely rotated about its vertical central axis 75 on the bearings 68 of the bearing housing 62.

The circular tray base 60 includes a raised perimeter rim 76 and has a raised central web 77 including six fingers 78 equally spaced and extending radially outwardly from this elevated web and each forming a 60° angle with the adjacent fingers 78, along with the elevated radial fingers 78, thereby providing six socket recesses 80 each having the identical configuration as the bottom ridge 48 and bottom portions of the containers 30. The concave curved regions 82 of the elevated web 77 are located between the elevated fingers 78, and these concave curved regions 82 conform in shape with the rounded vertices 40 on the containers 30 for snugly receiving this vertex when the containers are mounted in the tray base 60.

Accordingly, these socket recesses 80 which are of generally sector-shape and six in number, accommodate the receipt and nesting of six containers 30, two of which are illustrated in FIG. 6 in dash-and-dotted outline. The sector-shaped recesses 80 accommodate and accurately position the containers 30 in the rotatable tray base 60. Moreover, as the tray base is rotated, these pocket recesses 80 prevent the slidable movement of the containers on the tray, and, for that matter, prevent the containers from being dislodged or leaving the tray when it is rotated.

Figure 19:
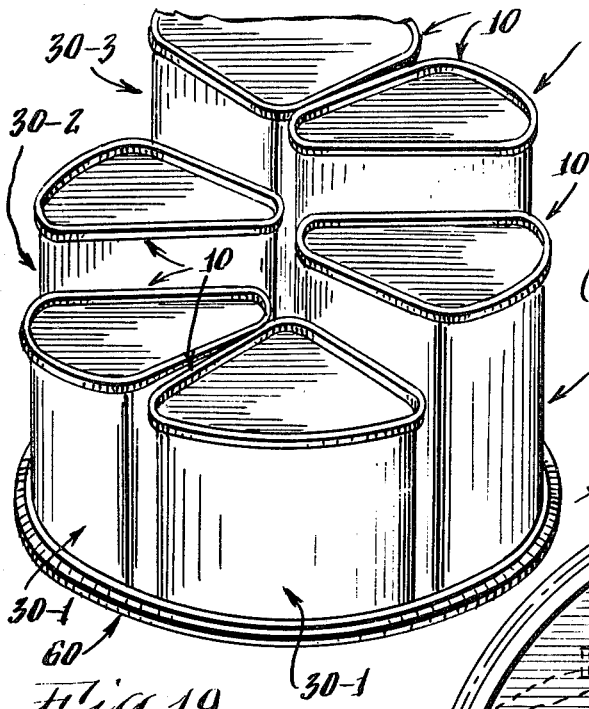
FIG. 19 is a perspective view of a modular set of six closed containers shown nested together on the rotatable tray of FIGS. 15 through 18.
Figure 23:
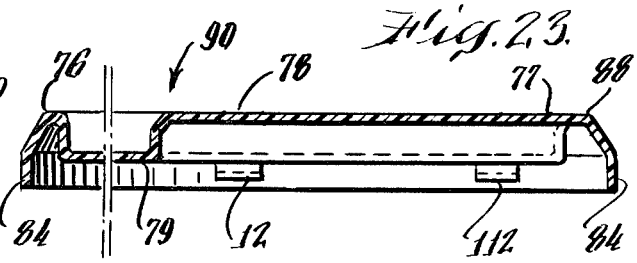
FIG. 23 is a partial cross-sectional view taken along line 23—23 in FIG. 20.

FIG. 19 illustrates the circular tray base 60 with a complete set 81 of sealed modular containers 30 seated therein. This figure also illustrates a set of these containers having the three heights discussed above, but they all have the same sector-shaped cross-sectional configuration at the bottom and at the top. As was pointed out previously, since the bottom ridges 48 on each of the containers 30 conform precisely to the socket recesses 15 in the tops of the lid closures 10, the containers may be stacked one upon another. In other words, more containers than the six which are shown may be accommodated for non-slidable arrangement both on the rotatable tray base 60 as well as a shelf or counter stacked arrangement as discussed further above. The height of the advantageous stacking arrangement will depend on the height of the storage space available in the cabinets, on the shelves, or in the refrigerator, as was described in detail above.

FIGS. 20 through 23 illustrate another aspect of the present invention, which includes a semi-circular mounting tray base or shelf referred to generally by the reference number 90. This tray base 90 has a pair of the raised radial fingers 78 extending from a central elevated web 77 at an angular spacing of 60° forming three socket recesses 80 of spector-shape between the fingers 78 and an elevated peripheral rim 76, 88 having a downturned skirt 84 extending therefrom. The central elevated web 77 is generally semi-circular and merges into the center of the straight portion 88 of the elevated rim. The center lines 96 of the radial fingers 78 meet at a point 98 in the center of the raised web 77, and the seim-circular arcuate shape of the rim 90 is concentric about this central point 98.

Figure 20:
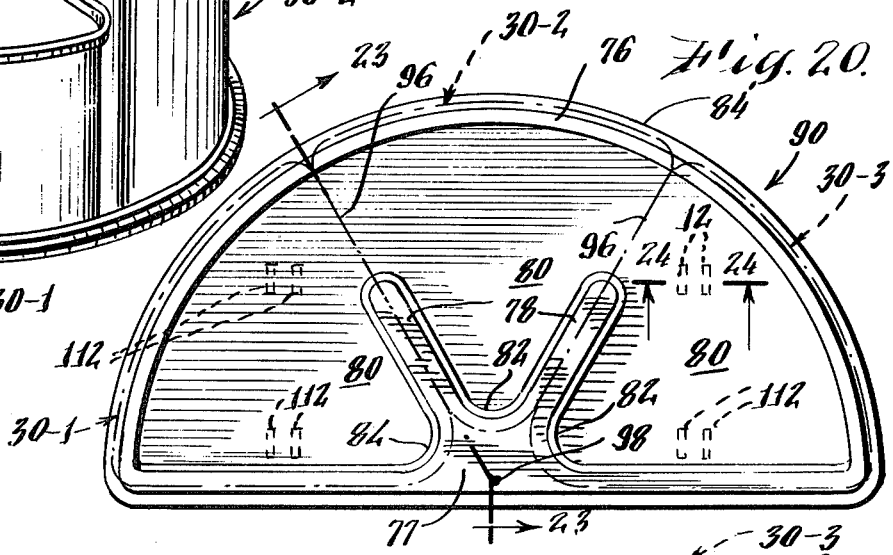
FIG. 20 is a top view of a semi-circular tray base shelf in accordance with the present invention, illustrated in dash-and-dotted outline three sector-shaped containers positioned thereon.
Figure 21:
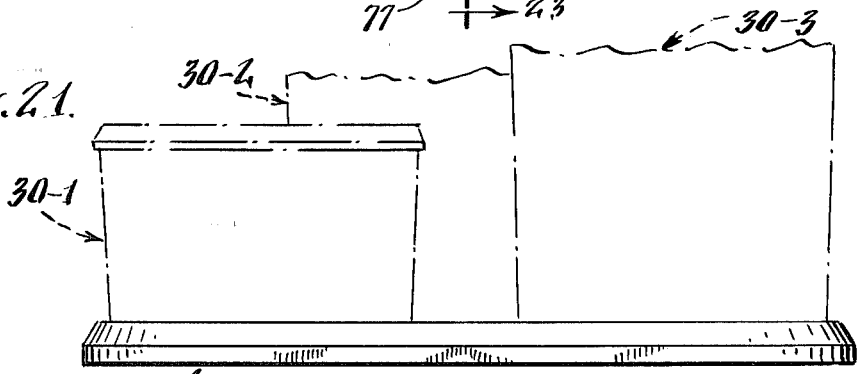
FIG. 21 is a side elevational view of FIG. 20.

As is illustrated in dash-and-dotted outline in FIG. 20, the socket recesses 80 are adapted to accommodate three containers 30. The semi-circular tray base 90 has a floor 90 with the fingers 78 and the elevated web 86 and the rim 76, 88 being elevated therefrom.

Figure 25:
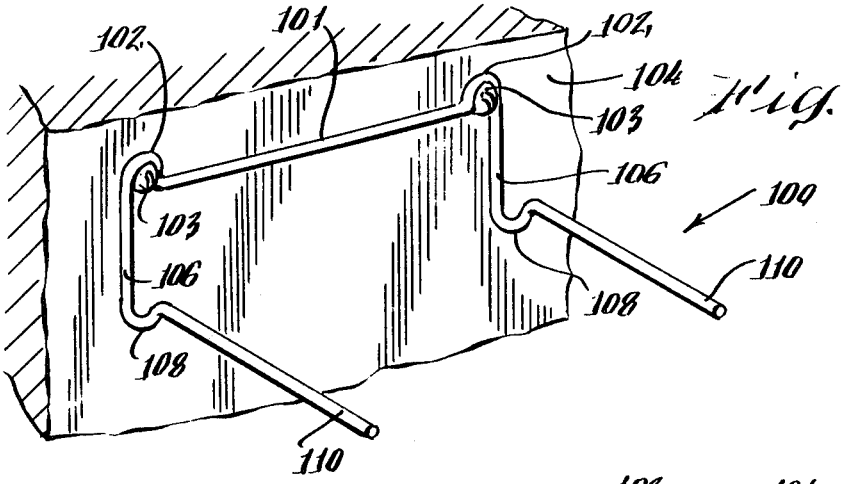
FIG. 25 is an enlarged perspective view of the bracket wire utilized to mount the semi-circular tray base shelf of FIGS. 20 through 23 on a wall.
Figure 26:
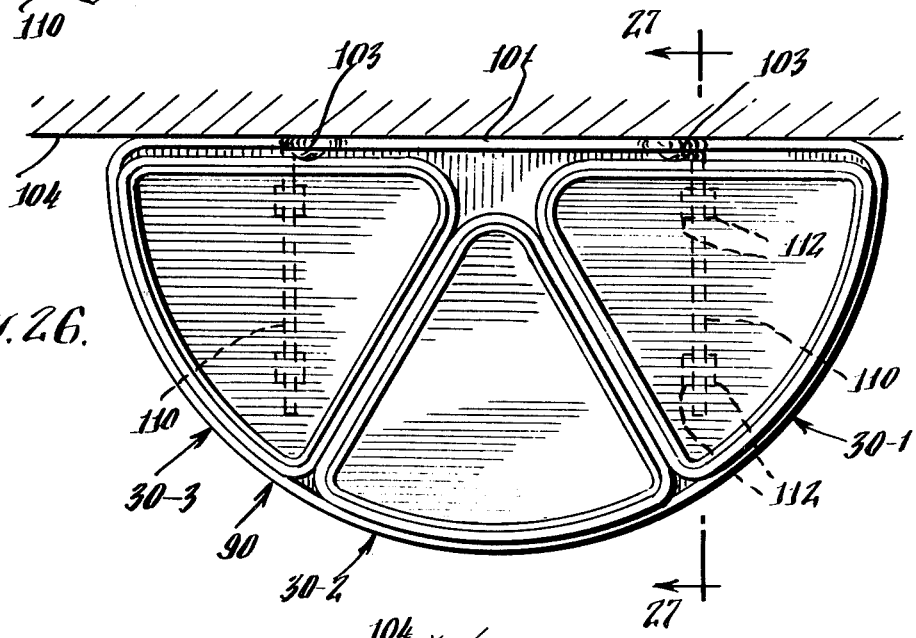
FIG. 26 is a top view of this semi-circular tray base shelf mounted on a wall with a set of three modular sector-shaped containers positioned thereon.

As will be seen in FIG. 25, a wire bracket 100 has a horizontal member 101 terminated at the ends thereof in inverted U-shaped loops 102 for accommodating the mounting of the bracket 100 by screws 103 to a wall or panel 104, for example a cabinet door panel. The outer legs of these loops are extended down to form vertical links 106 which are U-shaped bent for extending outwardly perpendicular to the plane of the member 101 and the links 106. These outwardly extending portions 110 form two parallel arms which are parallel to the plane of the tray base floor 79 onto a wall or panel.

Figure 24:
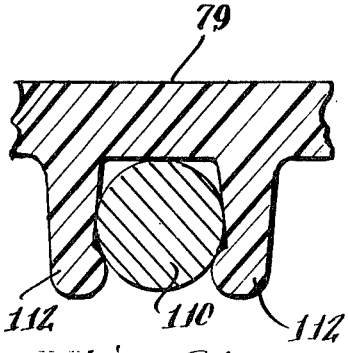
FIG. 24 is an enlarged cross-sectional view taken along line 24—24 of FIG. 20 showing the mounting bracket wire snapped in engagement between two containers.
Figure 22:
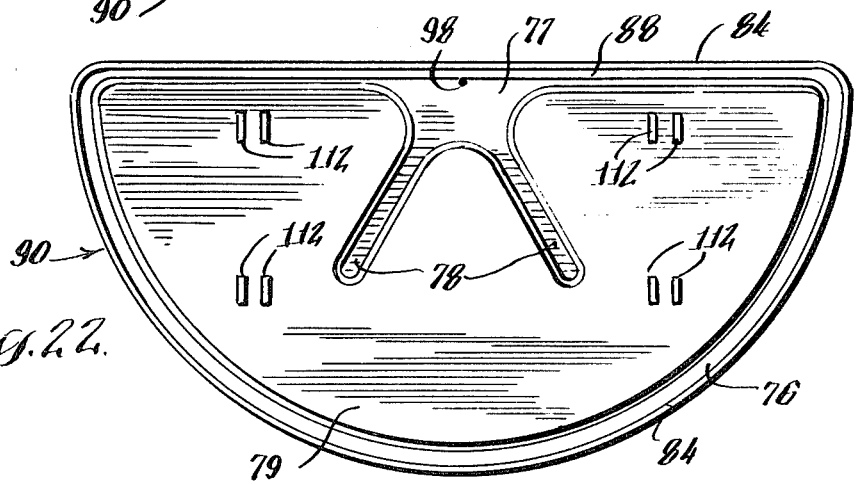
FIG. 22 is a bottom view of the semi-circular tray base shelf illustrated in FIGS. 20 through 23, before the bracket is snapped in place.

As illustrated in FIGS. 22 and 24, the floor 79 of the tray base 90 is fabricated with four pairs of downwardly projecting opposed resilient fingers 112. These fingers 112 are aligned in rows for receiving the supporting arms 110 (FIG. 25) of the bracket 100 inserted and captured between these resilient fingers in snap-in-fit relationship as shown enlarged in FIG. 24.

Figure 27:
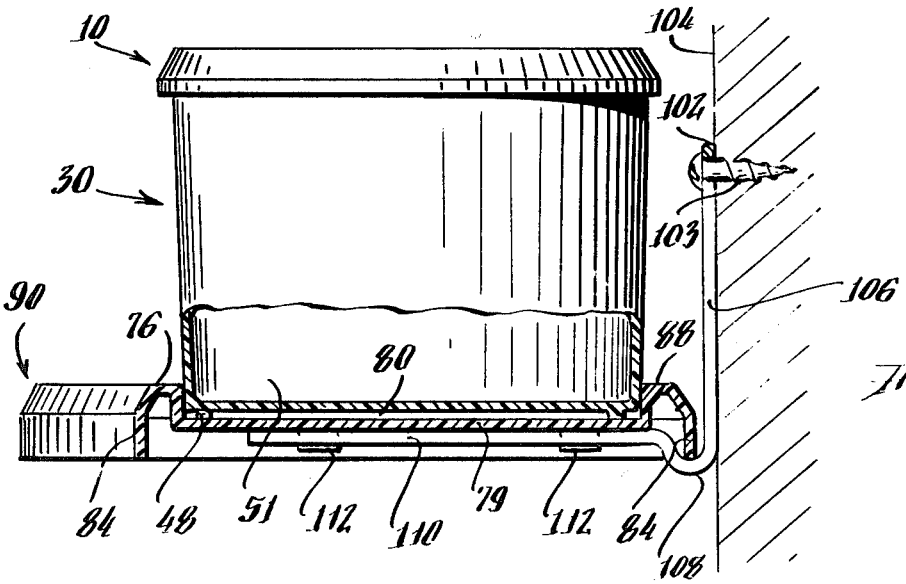
FIG. 27 is an enlarged cross-sectional view taken along line 27—27 of FIG. 26 with the container being shown partially in cross-section and partially in elevation.

As is clearly illustrated in FIG. 27, a lid covered container 30 is nestled in the socket recess 80 of the tray base 90, which is mounted on the arms 110 of the wire bracket 100. It is noted that the skirt 84 of the straight rim portion 88 of the semi-circular mounting tray 90 conveniently and neatly is positioned in the U-shaped bends 108 of the wire bracket 100. The weight of the containers 30 is firmly supported by the horizontal floor 79 which in turn is supported by the snap-in-fit horizontal arms 110 of the bracket and by the vertical link members 106 as those members bear against the wall and the anchoring screws, 103. It is to be noted that all of the space available on this tray base shelf 90 as provided by its semi-circular shape is neatly and conveniently occupied by the three sector-shaped containers 30 which may be of the same or different heights. Additional containers 30 can be stacked in any desired modular relationship as those on the wall-mounted tray shelf 90.

A food container system is thus provided which facilitates handling and storage of a wide variety and volume of food products. The containers are efficiently shaped for handling and storage, and the closures provide a triple seal and are easy to manipulate onto and off of the containers. The rotatable tray base accommodates six of the containers, whose configuration and modular heights enable them to be easily stacked one upon the other in a wide variety of desired arrangements. Furthermore, the tray base is so configured that the containers seated thereon are not only easily removed and replaced thereon, but are snugly captured therein to prevent sliding when the tray is removed.

The semi-circular tray base and shelf is functional and efficient, and provides an additional facility for this system in providing a semi-circular shelf which accommodates the same containers as the circular tray base.

Since other changes and modifications varied to fit particular operating requirements and environments will be understood by those skilled in the art, the invention is not considered limited to the examples chosen for purposes of illustration, and covers all changes and modifications which do not constitute a departure from the true spirit and scope of this invention.

What is claimed is:

1. A food container storage system adapted to store a variety of food items of varying size, shape and volume with a maximum volume for the area occupied with instant accessibility comprising:

a semi-circular tray shelf having a central elevated web located centrally and extending downwardly from along the diameter of said shelf;

a pair of elevated, equally spaced radial fingers extending from said web forming three sector-shaped compartments in said tray shelf;

an elevated arcuate rim on the circular periphery portion of said semi-circular shelf forming an arcuate retainer for said compartments;

a plurality of sector-shaped containers positioned in said compartments; and bracket mounting means for mounting said shelf on a wall or other vertical surface.

2. The food container storage system as claimed in claim 1 wherein:

said containers have recessed sector-shaped lid closure members;

said recessed sector-shaped closure members having a recessed configuration adapted to receive said containers;

whereby the containers may be conveniently stacked and retained one on top of another.

3. The food container storage system as claimed in claim 2 wherein;

said bracket mounting means includes a bracket having horizontal and vertical sections extending along the wall on which said bracket is mounted and a pair of parallel arms extending outwardly from said vertical sections, said shelf being mounted on said pair of parallel arms.

4. The food container storage system as claimed in claim 3 wherein;

said shelf has a plurality of pairs of spaced yieldable fingers aligned in rows;

said fingers forming channels therebetween adapted to receive and hold therein said pair of parallel arms of said shelf.

5. A food container storage system comprising a plurality of containers each having a sector-shaped hollow body formed by three upstanding side walls;

two of said side walls being substantially planar and oriented at a converging angle of 60° and merging to form a rounded vertex opposite to the third side wall;

said third side wall forming an arc of a circle which merges in rounded corners with said two planar side walls;

said arcuate side wall being concentric about a point near the location where said two converging side walls would meet if they were extended to a sharp vertex;

said container body having a sector-shaped planar bottom wall;

a sector-shaped, peripheral flange conforming to the configuration formed by said three side walls integrally formed along the rim of said side walls;

a sector-shaped lid closure member for said body container having a horizontal planar closure wall with an integrally formed sector-shaped skirt extending vertically downward therefrom which is adapted to fit internally into the rim of said body;

an elevated upstanding rim on said horizontal closure wall having a downturned lip forming an angled channel having a sector-shaped configuration adapted to receive said rim and peripheral flange of said side walls;

a pair of spaced parallel horizontal, sealing ridges extending outwardly on the external surface of said sector-shaped skirt adapted to contact the interior surfaces of said three side walls of said container body when said lid closure is mounted on said body for double sealing said container, and said rim and peripheral flange nesting in said angled channel for providing a third seal;

said downturned lip overhanging and providing clearance between said lid closure member and the flange on said body for permitting the ready removal of the triple-sealed closure member from said container body;

a circular-shaped rotatable tray base with a central elevated web having six uniformly spaced radial fingers extending therefrom angularly spaced 60° apart forming sector-shaped socket recesses in said tray base adapted to receive and retain said containers therein;

said tray base having a raised peripheral rim opposite said web forming an outside arcuate barrier for said socket recesses in said tray base;

whereby said containers are restricted from sliding about on said rotatable tray; and said rim of said tray base has a downturned skirt extending therefrom which extends attractively below the level of the socket recesses formed in said rotatable tray base.

6. A food container storage system comprising a plurality of containers each having a sector-shaped hollow body formed by three upstanding side walls;

two of said side walls being substantially planar and oriented at a converging angle of 60° and merging to form a rounded vertex opposite to the third side wall;

said third side wall forming an arc of a circle which merges in rounded corners with said two planar side walls;

said arcuate side wall being concentric about a point near the location where said two converging side walls would meet if they were extended to a sharp vertex;

said container body having a sector-shaped planar bottom wall;

a sector-shaped, peripheral flange conforming to the configuration formed by said three side walls integrally formed along the rim of said side walls;

a sector-shaped lid closure member for said body container having a horizontal planar closure wall with an integrally formed sector-shaped skirt extending vertically downward therefrom which is adapted to fit internally into the rim of said body;

an elevated upstanding rim on said horizontal closure wall having a downturned lip forming an angled channel having a sector-shaped configuration adapted to receive said rim and peripheral flange of said side walls;

a pair of spaced parallel horizontal, sealing ridges extending outwardly on the external surface of said sector-shaped skirt adapted to contact the interior surfaces of said three side walls of said container body when said lid closure is mounted on said body for double sealing said container, and said rim and peripheral flange nesting in said angled channel for providing a third seal;

said downturned lip overhanging and providing clearance between said lid closure member and the flange on said body for permitting the ready removal of the triple-sealed closure member from said container body;

a semi-circular-shaped tray base, said tray base having a raised partial web located centrally along the diametric straight rim portion of said semi-circular tray base and extending outwardly therefrom;

said web having a pair of radial, equally spaced fingers extending outwardly therefrom with an angular spacing of 60° between them forming three sector-shaped socket recesses and mounting means for mounting said semi-circular tray base on a wall or other vertical surface;

said tray base having a raised peripheral rim opposite said web forming an outside arcuate barrier for said socket recesses in said tray base;

whereby said containers are restricted from sliding about on said rotatable tray; and said rim of said tray base has a downturned skirt extending therefrom which extends attractively below the level of the socket recesses formed in said tray base.

7. The food container storage system as claimed in claim 6 wherein:

said mounting means includes a bracket having horizontal and vertical sections extending along the wall on which said bracket is mounted; and a pair of parallel arms extending perpendicularly outwardly from said vertical sections, said tray base being mounted on said pair of parallel arms.

8. The food container storage system as claimed in claim 7 wherein:

said tray base has a plurality of pairs of spaced yieldable fingers;

said fingers being aligned in rows forming a pair of channels therebetween adapted to receive and hold therein said pair of parallel arms of said bracket.

9. A modular food container storage system for storing a variety of food items of varying size, shape and volume with convenient accessibility comprising:

a tray base having a perimeter extending along at least a semi-circular portion of a circular arc;

said tray base having a floor with an elevated rim extending along the perimeter of said tray base, said rim being elevated above the level of said floor;

said tray base also having a plurality of elevated fingers extending radially toward said perimeter, said radial fingers being angularly spaced 60° about a common point;

said floor and elevated rim and elevated radial fingers defining at least three sector-shaped socket recesses each adapted to receive the bottom portion of a sector-shaped container; and at least three sector-shaped containers for seating in the respective socket recesses; and each of said containers having a hollow body formed by three upstanding side walls;

two of said side walls being substantially planar and converging at an angle of 60° and merging to form a rounded vertex opposite to the third side wall;

said third side wall following a horizontal arc of a circle and said third side wall merging in rounded corners with said two planar side walls;

said circular arc being concentric about a point at which said two side walls would meet at a sharp vertex if extended;

said container body having a sector-shaped planar horizontal bottom wall;

each of said containers having a lid closure defining a socket recess in the top of the lid closure having a sector-shaped outline which is the same as seen in plan view with the sector-shaped outline of each of the socket recesses in said tray base;

said containers having relative heights in the ratio of one to two to three;

said tray base being semi-circular in outline as seen in plan view;

a portion of said elevated rim extends straight diametrically across said tray base; and mounting means for mounting said tray base on a wall or other vertical surface with said straight elevated rim portion adjacent to the surface on which said tray base is mounted.

10. The modular food storage container system as claimed in claim 9, in which:

said containers have heights of three, six and nine inches.

11. A food container storage system as claimed in claim 5, in which:

said lid closure member has a rounded corner overhanging said angled channel; and said rim of said container body engages said corner in said angled channel for providing said third seal.

* * * * *